US007261297B2

(12) United States Patent
Bermudez

(10) Patent No.: US 7,261,297 B2
(45) Date of Patent: Aug. 28, 2007

(54) METHOD AND APPARATUS FOR PLAYING BLACKJACK WITH A SIDE WAGER

(76) Inventor: Rigoberto M. Bermudez, 211 Holly La., Oswego, IL (US) 60543

( * ) Notice: Subject to any disclaimer, the term of this patent is extended or adjusted under 35 U.S.C. 154(b) by 223 days.

(21) Appl. No.: 10/908,927

(22) Filed: Jun. 1, 2005

(65) Prior Publication Data

US 2006/0273512 A1 Dec. 7, 2006

(51) Int. Cl.
*A63F 1/00* (2006.01)

(52) U.S. Cl. ..... 273/292; 463/12; 273/274

(58) Field of Classification Search ..... 273/292, 273/274, 309; 463/12, 13
See application file for complete search history.

(56) References Cited

U.S. PATENT DOCUMENTS 5,636,842 A * 6/1997 Cabot et al. ..... 273/292
5,921,550 A * 7/1999 Awada ..... 273/292
5,988,643 A * 11/1999 Awada ..... 273/292
6,102,403 A 8/2000 Kaufman
6,206,375 B1 * 3/2001 Wichinsky ..... 273/292
6,343,789 B1 * 2/2002 Webb ..... 273/274
6,481,718 B2 11/2002 Koelling
6,612,580 B1 9/2003 Weldon
6,854,731 B2 2/2005 Saucier

* cited by examiner

*Primary Examiner*—Bejamin Layno
(74) *Attorney, Agent, or Firm*—Gregory T. Zalecki

(57) ABSTRACT

A platform for playing blackjack is used to implement a method of playing blackjack with a side wager. Each playing position on the platform has a side bet betting area having a first card betting area and a second card betting area. A player places an optional additional bet in the first card betting area or the second card betting area associated with the player's playing position. Each player is dealt two cards. If the player's first card ranks higher than the player's second card and the player placed a bet in the first card betting area, the player wins. If the player's second card ranks higher than the player's first card and the player placed a bet in the second card betting area, the player wins. The game continues to completion according to the traditional rules of blackjack.

10 Claims, 2 Drawing Sheets

METHOD AND APPARATUS FOR PLAYING BLACKJACK WITH A SIDE WAGER

BACKGROUND

Blackjack is a popular game. The rules of blackjack are well known. It can be played in public arenas such as gambling casinos. It can also be played privately among a group of friends.

Blackjack is an entertaining game. Individual players are attracted to it because of the possibility of gambling winnings. Businesses are attracted to it because it can be a source of income. Its rules are easy to learn.

One of the problems with blackjack is that it can become boring and monotonous to players. It can also be viewed by gambling casinos as providing insufficient profit.

What is needed is a variation in the method of playing blackjack, as well as an apparatus for carrying out the this method, having the following features. The modified game would be simple to learn, understand and play. It would be interesting and entertaining. It would encourage increased betting by players by increasing the potential winnings of players. It would increase profits to the house by creating increased betting activity. The house advantage resulting from the variation would be a reasonable advantage from the perspective of a player, as well as from the perspective of the house. The house advantage would not be so great that it would discourage player participation. On the other hand, the house advantage would be sufficient to produce a reasonable profit for the house.

SUMMARY

A method of playing blackjack with a side wager is comprised of the steps of providing a platform, a bet being placed by each player, at least one player placing an additional bet, dealing two cards to each player, determining the outcome of each additional bet and continuing to deal cards and settle bets according to the rules of the game of blackjack. The method includes a side wager by at least one player against a dealer.

The platform is typically a modified blackjack table. The platform can also be an electronic gaming device, a computer program with software or a computer connected to a network. The platform has at least one playing position. Typically, the platform has seven playing positions. Each of the playing positions is associated with a primary betting area and a side bet betting area. The primary betting area of each playing position is the betting area associated with each playing position in a traditional blackjack game. Each side bet betting area has a first card betting area and a second card betting area. At least one player is associated with one of the playing positions.

Each player places a bet within the player's primary betting area. This bet is a traditional blackjack bet.

At least one player places an additional bet. That bet is placed within the player's side bet betting area. The player places the bet within the player's first card betting area or the player's second card betting area.

The dealer deals each of the players a first card and a second card for a total of two cards per player. This is in accordance with the traditional rules of blackjack.

The outcome of each additional bet is determined. The determination is made by comparing the first card of that player with the second card of that player. The results of that comparison are then compared with the particular side bet betting area selected by the player in order to determine whether the player has won the bet, lost the bet or the bet is a push.

The dealer continues to deal cards and settle the bets of each player placed within the player's primary betting area. The cards are dealt and the bets are settled according to the traditional rules of blackjack.

The preferred method of determining the outcome of each additional bet comprises comparing the rank of the player's first card with the rank of the player's second card. The player wins the additional bet if the player's first card has a higher rank than the player's second card and the player placed an additional bet within the player's first card betting area. The player wins the additional bet if the player's second card has a higher rank than the player's first card and the player placed an additional bet within the player's second card betting area. The player loses the additional bet if the player's first card has a lower rank than the player's second card and the player placed an additional bet within the player's first card betting area. The player loses the additional bet if the player's second card has a lower rank than the player's first card and the player placed an additional bet within the player's second card betting area.

The preferred method of determining the outcome of each additional bet when the player's first card and second card have the same rank is as follows. The player wins the additional bet if the player's first card and second card have the same rank and the same color, but are not suited. The player loses the additional bet if the player's first card and second card have the same rank, but do not have the same color. The bet is a push if the player's first card and second card have the same rank and the same suit.

The methods described can be implemented on a traditional blackjack table modified to contain a side bet betting area for each player. The methods can also be implemented on an electronic gaming device, a computer programmed with software and a computer connected to a network.

The apparatus used for playing blackjack with a side wager by at least one player against a dealer is comprised of a platform for playing blackjack. The platform has at least one playing position. Preferably, the platform has seven playing positions. Each playing position is associated with a primary betting area and a side bet betting area. Each side bet betting area has a first card betting area and a second card betting area. The first card betting area is for betting that the player's first card will be ranked higher than the player's second card. The second card betting area is for betting that the player's second card will be ranked higher than the player's first card. The apparatus may also contain a legend summarizing some or all of the rules for determining the outcome of additional bets, as described above.

The platform may be a blackjack playing table, an electronic gaming device, a computer programmed with software, or a computer connected to a network, including the Internet.

DRAWINGS

These and other features, aspects, and advantages of the present invention will become better understood with regard to the following description, appended claims, and accompanying drawings where:

DETAILED DESCRIPTION

Figure 1:
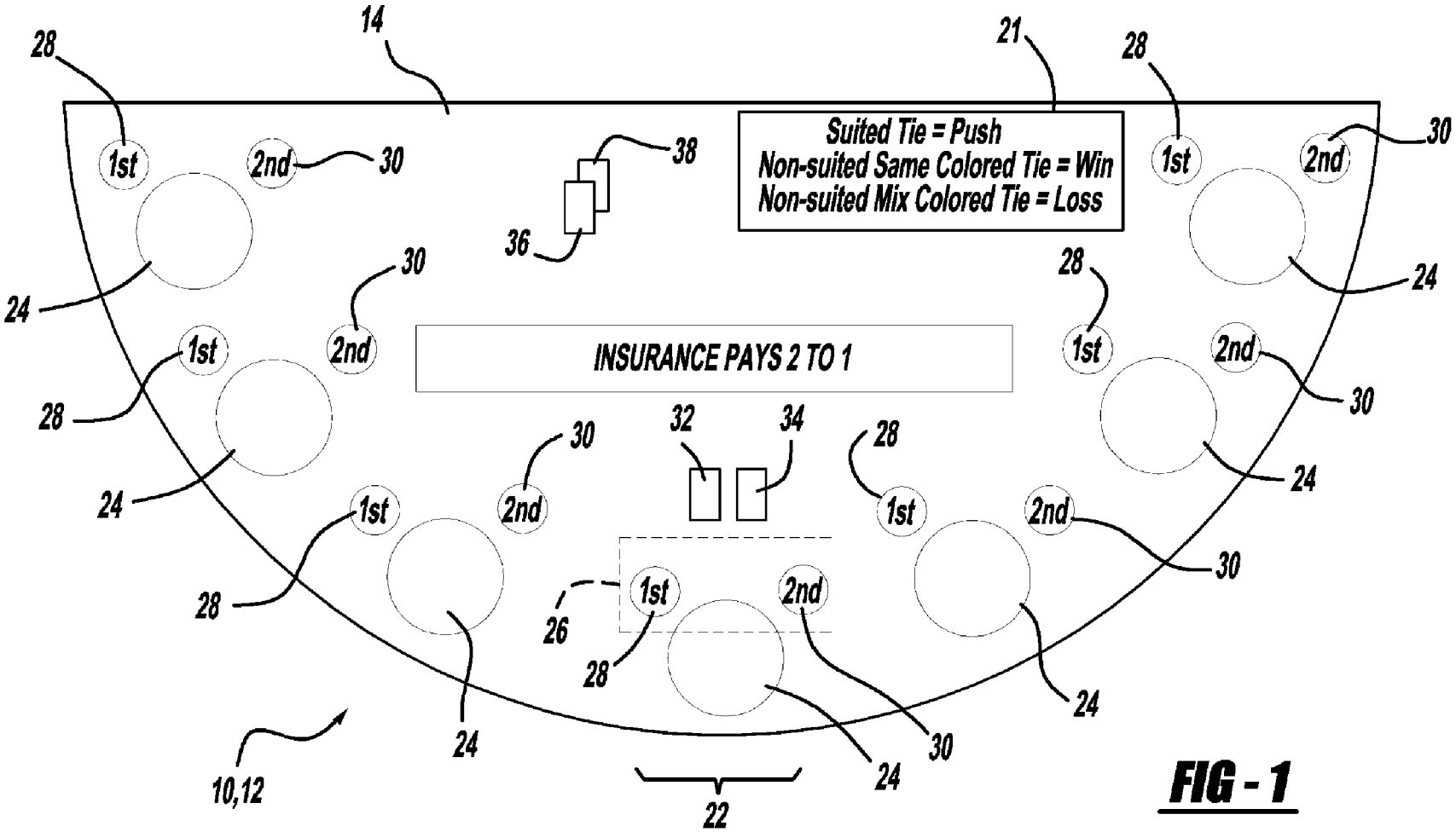
FIG. 1 is a plan view of an apparatus for playing blackjack with a side wager by at least one player against a dealer.

The preferred apparatus 10 for playing blackjack with a side wager by at least one player against a dealer is shown in FIG. 1. The apparatus 10 is comprised of a platform 12. The platform 12 should be in the shape of a traditional blackjack table 14. The table 14 should be covered with green felt. The platform 12 has at least one playing position 22. Preferably, the table 14 has seven playing positions 22. Each playing position 22 is associated with a primary betting area 24 and a side bet betting area 26. Each primary betting area 24 should be in the form of a circle. The circle should be colored white. Each side bet betting area 26 has a first card betting area 28 and a second card betting area 30. Each first card betting area 28 and each second card betting area 30 should be in the form of circles adjacent to the primary betting area 24 to which the first card betting area 28 and the second card betting area 30 are associated. The first card betting area 28 is for betting that a player's first card will be ranked higher than a second card dealt to that player. The second card betting area 30 is for betting that a player's second card will be ranked higher than a first card dealt to that player. The apparatus 10 may also contain a legend 21 summarizing some or all of the rules for determining the outcome of additional bets, as described below.

The method of playing blackjack with a side wager is comprised of the steps of providing a platform 12, a bet being placed by each player, at least one player placing an additional bet, dealing two cards 32, 34 to each player, determining the outcome of each additional bet and continuing to deal cards and settle bets according to the rules of the game of blackjack. The method includes a side wager by at least one player against a dealer.

The first step of the preferred method of playing blackjack with a side wager by at least one player against a dealer is to provide a platform 12 for playing blackjack. Preferably, the platform 12 is a blackjack table 14, as described.

Each player places a bet within the player's primary betting area 24. This is a traditional blackjack bet and will be controlled by the traditional rules of blackjack. Typically, money or gambling chips are placed within a circle defining the player's primary betting area 24.

At least one player places an additional bet within the player's side bet betting area 26. This is accomplished by placing a bet within the player's first card betting area 28 or the player's second card betting area 30.

The dealer deals each of the players playing the game a first card 32 and a second card 34. This is in accordance with the traditional rules of blackjack. Also, in accordance with the traditional rules of blackjack, the dealer is dealt a face up card 36 and a face down card 38. Variations in the rules of blackjack exist wherein both of the dealer's cards 36, 38 are either face up or face down. These variations do not affect the described method of playing blackjack with a side wager by at least one player against a dealer.

The outcome of each additional bet is determined by comparing the player's first card 32 with the player's second card 34 and by comparing the results of that comparison with the particular side bet betting area 28, 30 selected by the player. The preferred rules for determining the outcome of each additional bet are as follows. The player wins the additional bet if the player's first card 32 has a higher rank than the player's second card 34 and the player placed a side bet within the player's first card betting area 28. The player wins the additional bet if the player's second card 34 has a higher rank than the player's first card 32 and the player placed a side bet within the player's second card betting area 30. The player loses the additional bet if the player's first card 32 has a lower rank than the player's second card 34 and the player placed a side bet within the player's first card betting area 28. The player loses the additional bet if the player's second card 34 has a lower rank than the player's first card 32 and the player placed a side bet within the player's second card betting area 30. The terms additional bet, side wager and side bet are synonymous herein. Traditional rules of card ranking should be used. Those rules provide that numbered cards are ranked in order of their number and face cards are ranked in the following order: Jack, Queen, King, Ace. The Ace should be ranked as the highest card.

Periodically the player's first card 32 and the player's second card 34 will have the same rank. If the player's first card 32 and the player's second card 34 have the same rank and are not suited, but have the same color, the player wins the additional bet. If the player's first card 32 and the player's second card 34 have the same rank, but do not have the same color, the player loses the additional bet. If the player's first card 32 and the player's second card 34 have the same rank and the same suit, the additional bet is a push.

Preferably, a winning additional bet is paid at 1 to 1 odds. Thus, a $10 winning bet would be paid $10.

The dealer continues to deal cards and settle the bets of each of the players placed within the player's primary betting area according to the rules of the game of blackjack. Typically, the game is played with six to eight decks of cards. The players hit (request an additional card) or stand (request no additional card) according to their own game strategy. The blackjack rules provide that a player busts (loses) when the total of the player's card exceeds 21. In order to win a player's primary bet the dealer must bust before the player busts, or the player's total must exceed the dealer's total.

Figure 2:
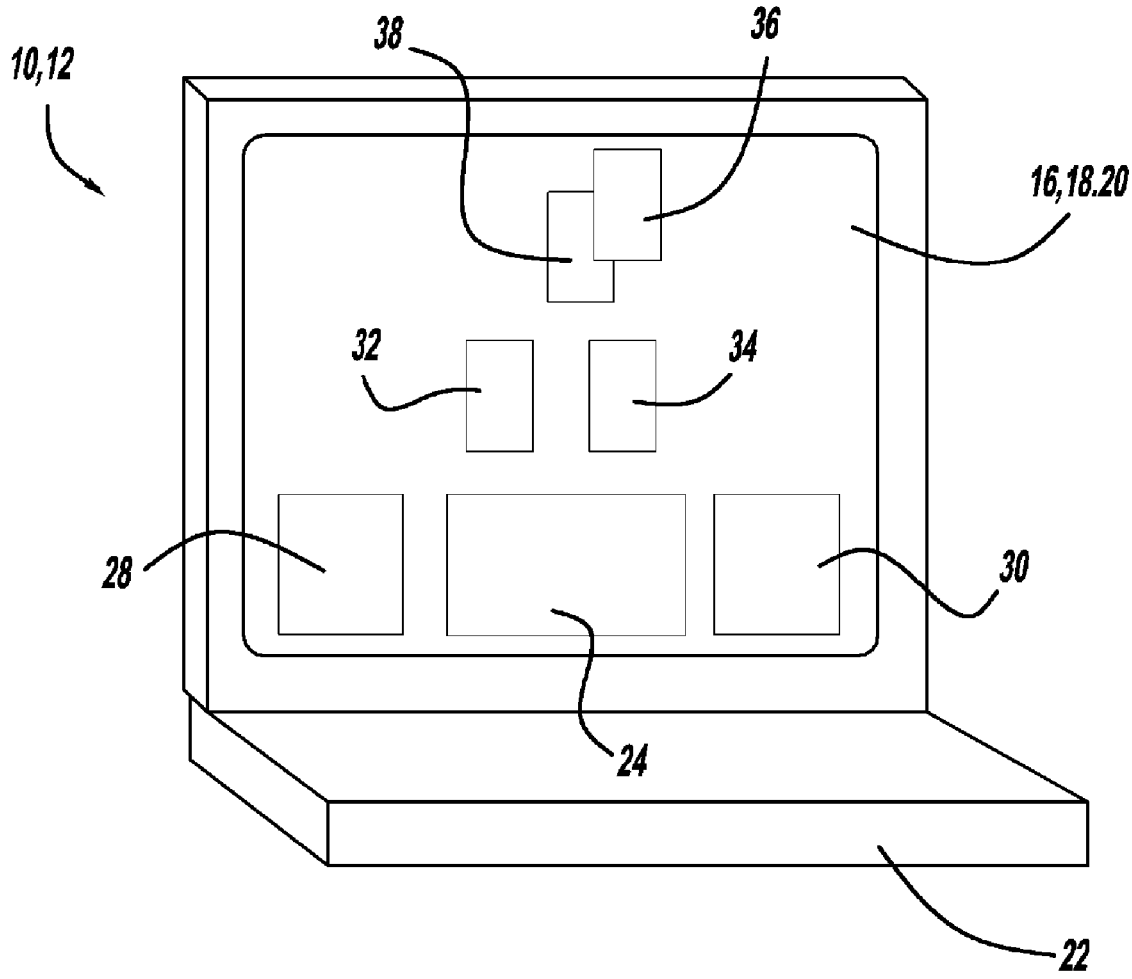
FIG. 2 is a perspective view of an apparatus for playing blackjack with a side wager by at least one player against a dealer wherein the platform for playing blackjack is in the form of an electronic gaming device, a computer programmed with software or a computer connected to a network.

The method of playing blackjack with a side wager by at least one player against a dealer may be implemented within an electronic gaming device 16, a computer programmed with software 18 or a computer connected to a network 20, as shown in FIG. 2. These devices have a visual display. The visual display contains a primary betting area 24, a first card betting area 28 and a second card betting area 30. The first card betting area 28 and the second card betting area 30 define the side betting area 26. The player controls the amounts of the player's primary bet and any additional bet. The amount of the player's primary bet is displayed in the primary betting area 24. The amount of the player's additional bet is shown in the player's first card betting area 28 or the player's second card betting area 30, as determined by the player. The visual display shows the player's first card 32 and the player's second card 34, as well as the dealer's cards 36, 38. The rules for the method of playing blackjack with a side wager, as described, are programmed into the platform 12, whether the platform 12 is an electronic gaming device 16, a computer programmed with software 18 or a computer connected to a network 20. When the platform is a computer connected to a network 20 multiple players and a dealer may play the game with each other without being within the physical proximity of each other.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions and methods insofar as they do not depart from the spirit and scope of the present invention.

What is claimed is:

1. A method of playing blackjack with a side wager by at least one player against a dealer, comprising the steps of:

providing a platform for playing blackjack, said platform having at least one playing position, each said playing position being associated with a primary betting area and a side bet betting area, each said side bet betting area having a first card betting area and a second card betting area, wherein at least one player is associated with one of the at least one playing positions;

each player placing a bet within the player's primary betting area for playing the game of blackjack;

at least one player placing an additional bet within the player's side bet betting area by placing a bet within the player's first card betting area or the player's second card betting area;

the dealer dealing each of the at least one players a first card and a second card for a total of two cards per player;

determining the outcome of each additional bet placed by each player placing an additional bet according to the following rules:

if the player's first card has a higher rank than the player's second card and the player placed an additional bet within the player's first card betting area, the player wins the additional bet;

if the player's second card has a higher rank than the player's first card and the player placed an additional bet within the player's second card betting area, the player wins the additional bet;

if the player's first card has a lower rank than the player's second card and the player placed an additional bet within the player's first card betting area, the player loses the additional bet;

if the player's second card has a lower rank than the player's first card and the player placed an additional bet within the player's second card betting area, the player loses the additional bet; and continuing to deal cards and settle the bets of each of the at least one players placed within that player's primary betting area according to the rules of the game of blackjack.

2. The method of playing blackjack of claim 1, wherein the step of determining the outcome of each additional bet placed by each player placing an additional bet further comprises the following rules:

if the player's first card and second card have the same rank and are not suited, but have the same color, the player wins the additional bet;

if the player's first card and second card have the same rank, but do not have the same color, the player loses the additional bet; and if the player's first card and second card have the same rank and the same suit, the additional bet is a push.

3. The method of playing blackjack of claim 2, wherein the platform comprises a blackjack playing table.

4. The method of playing blackjack of claim 2, wherein the platform comprises an electronic gaming device.

5. The method of playing blackjack of claim 2, wherein the platform comprises a computer programmed with software.

6. The method of playing blackjack of claim 2, wherein the platform comprises a computer that is connected to a network.

7. The method of playing blackjack of claim 1, wherein the platform comprises a blackjack playing table.

8. The method of playing blackjack of claim 1, wherein the platform comprises an electronic gaming device.

9. The method of playing blackjack of claim 1, wherein the platform comprises a computer programmed with software.

10. The method of playing blackjack of claim 1, wherein the platform comprises a computer that is connected to a network.

* * * * *